US005197535A

United States Patent [19]

Mulcahy

[11] Patent Number: 5,197,535

[45] Date of Patent: Mar. 30, 1993

[54] LIQUID METAL STIRRING DURING CASTING

[75] Inventor: Joseph A. Mulcahy, Brooklin, Canada

[73] Assignee: J. Mulcahy Enterprises Inc., Whitby, Canada

[21] Appl. No.: 761,315

[22] Filed: Sep. 17, 1991

[51] Int. Cl.[5] ..... B22D 11/06; B22D 27/02

[52] U.S. Cl. ..... 164/468; 164/428; 164/480; 164/504

[58] Field of Search ..... 164/428, 480, 468, 504, 164/502, 466

[56] References Cited

FOREIGN PATENT DOCUMENTS 62-104653 5/1987 Japan ..... 164/480

*Primary Examiner*—Kuang Y. Lin

*Attorney, Agent, or Firm*—Sim & McBurney

[57] ABSTRACT

Twin-roll casting of molten metal to form a continuous cast metal strand is improved by electromagnetic stirring of molten metal immediately upstream of the nip between the rolls to provide a substantially homogenized melt of substantially uniform temperature upstream of the nip.

5 Claims, 2 Drawing Sheets

LIQUID METAL STIRRING DURING CASTING

FIELD OF INVENTION

The present invention relates to the casting of liquid metals.

BACKGROUND TO THE INVENTION

Casting of liquid metals to form shaped structures is well known and a variety of procedures has been adopted in this regard. One such procedure is known as twin-roll casting and is effected to a limited extent on a variety of metals to produce strip metal.

In twin-roll casting, a liquid metal is poured into the gap between two rolls, generally of the same dimension. The rolls are cooled, so that the long face of the liquid metal is chilled against the roll, so that the solid strip is formed in and is defined by the gap between the rolls. End containment of the molten metal generally is effected by stationary-shaped refractory pieces held as closely as possible to the moving rolls.

Another conventional casting operation is known as levitation casting which employs a high current conductor at a particular frequency surrounding a liquid metal pool. The induced current in the liquid metal causes a force to develop between the conductor and the metal which repels the liquid metal from the conductor and holds it above a frozen form of the same metal which is continuously removed.

SUMMARY OF INVENTION

In accordance with the present invention, there is provided an improvement in twin-roll casting wherein the molten metal is stirred electromagnetically immediately upstream of the nip between the rolls to provide a substantially homogenized melt of substantially uniform temperature upstream of the nip. By electromagnetically stirring the molten metal in this manner, an improved casting operation is achieved.

In one embodiment of the invention, the electromagnetic stirring is effected by passing a high current of suitable frequency from one end to the other of each of the casting drums to effect current flow largely in the zone of the meniscus of molten metal in contact with the drum.

DESCRIPTION OF PREFERRED EMBODIMENT

Figure 1:
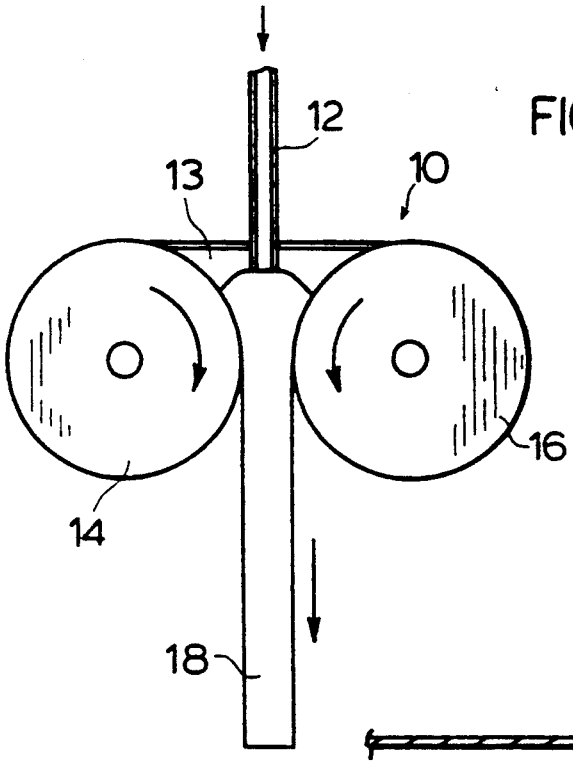
FIG. 1 is a schematic view of a typical prior art twin-roll caster.

FIG. 1 shows a conventional twin-roll caster 10. Liquid metal is poured through a pipe 12 to form a pool of molten metal enclosed by a refractory dam 13. The molten metal passes from the pool between a pair of counter-rotating rolls 14, 16 where the long face of the molten metal is chilled against the roll and a strand 18 of solidified metal results which is removed from the nip.

Figure 2:
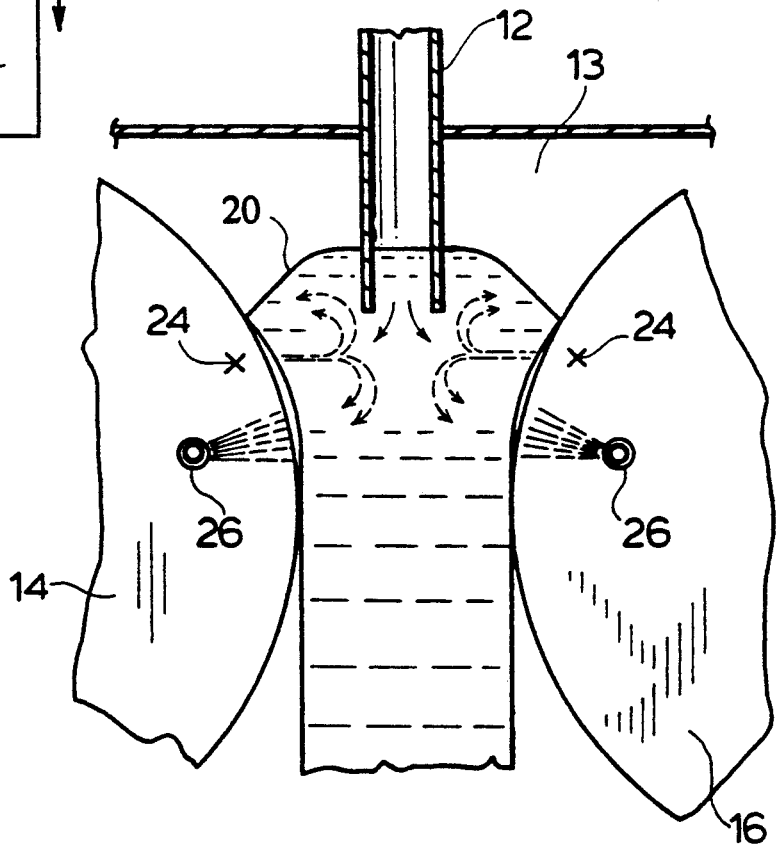
FIG. 2 is a close-up end view of a twin-roll caster, modified in accordance with one embodiment of the invention.
Figure 3:
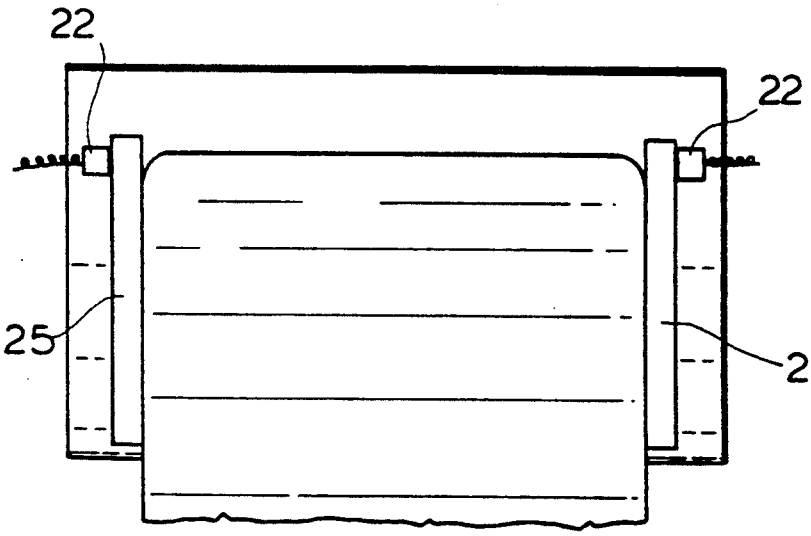
FIG. 3 is a close-up front elevational view of the twin-roll caster of FIG. 1.

In the present invention, as seen in FIGS. 2 and 3, an electrical current of suitable frequency is passed from one end of each of the drums 14, 16 to the other, so that current flow occurs mainly in the region of the meniscus 20 of the molten metal.

This result is achieved by coating the drums 14 and 16 with copper, or other highly-conductive metal, and providing a pair of electrical brushes 22, one at each end of each drum, to establish an electrically-conductive path 24 therebetween along the face of the drum.

The opposing force of the conductive path 24 along the drum 14 or 16 and the liquid metal causes the liquid metal to stand off from the external surface of the drum, as seen in FIG. 2. The force on the metal also causes rotation of the liquid metal, also as seen in FIG. 2, which ensures homogenization of the metal upstream of the nip.

This arrangement ensures greater uniformity of temperature and more effective temperature control on the liquid metal upstream of the nip, so that the critical requirement can be met that the liquid metal, confined between suitable dams 25, be solid in the nip, rather than upstream or downstream of the nip.

Water spray cooling of the drums 14 and 16 is effected at 26, downstream of the location of current path 24 to remove heat from the metal. The conductive path 24 does not require separate cooling.

The current may tend to diffuse in its path across the drum between the brushes 22. However, the diffusion is minimized by the change to higher resistivity in the region of metal cooling.

The current passing through the conductive path 24 also serves to preheat the copper surface of the drum just prior to contact with the liquid metal, lessening the undesired shock freezing normally associated with meniscus contact.

SUMMARY OF DISCLOSURE

In summary of this disclosure, the present invention provides a novel method and apparatus for effecting twin-roll casting which ensures an effective manner of operation. Modifications are possible within the scope of this invention.

What I claim is:

1. In the twin-roll casting of molten metal by pouring a molten metal into the nip between a pair of counter-rotating casting drums to form a pool of molten metal upstream of said nip and having a longitudinal dimension parallel to said nip and removing a solidified strand of metal from the nip, the improvement which comprises:

electromagnetically stirring said molten metal in said pool along said longitudinal dimension in the region immediately upstream of the nip to provide a substantially homogenized melt of substantially uniform temperature upstream of the nip.

2. In the twin-roll casting of molten metal by pouring a molten metal into the nip between a pair of counter-rotating casting drums and removing a solidified strand of metal from the nip, the improvement which comprises:

electromagnetically stirring said molten metal immediately upstream of the nip to provide a substantially uniform temperature upstream of the nip by passing an electrical current from one longitudinal end to another longitudinal end of said casting drums to effect current flow in the zone of the meniscus of molten metal in contact with the drum.

3. The method of claim 2 wherein said electrical current possesses a value and frequency sufficient to cause the liquid metal to stand off from the surface of drum in the region of said current flow.

4. In a twin-roll caster comprising a pair of counter-rotating drums, the improvement which comprises electrically-conducting path means extending between the longitudinal extremities of and located in the outer surface of each said drums immediately upstream of the nip between said drums.

5. The caster claimed in claim 4, wherein each said drum has a surface of electrically-conductive metal, and said electrically-conductive path means in said surface is provided by a pair of stationary electrical brushes associated with each said drum and in electrical contact with said surface of said drum.

* * * * *